US006551171B1

(12) United States Patent
Hass et al.

(10) Patent No.: US 6,551,171 B1
(45) Date of Patent: Apr. 22, 2003

(54) BRASSIERE WITH DETACHABLE UNIFORM PRESSURE ASSEMBLY

(76) Inventors: Brian Hass, 2165 Radnor Rd., North Palm Beach, FL (US) 33480; Linda Schaeffer, 4051 Thyme Dr., Palm Beach Gardens, FL (US) 33418

( * ) Notice: Subject to any disclaimer, the term of this patent is extended or adjusted under 35 U.S.C. 154(b) by 0 days.

(21) Appl. No.: 10/056,389

(22) Filed: Jan. 24, 2002

(51) Int. Cl.[7] ..... A41C 3/00
(52) U.S. Cl. ..... 450/57; 450/1
(58) Field of Search ..... 450/1, 57, 54–56, 450/60–75; 2/267, 455

(56) References Cited

U.S. PATENT DOCUMENTS

| | | | | |
|---|---|---|---|---|
| 1,106,184 A | | 8/1914 | Bevoise | |
| 1,362,027 A | | 12/1920 | Miller | |
| 1,506,248 A | | 8/1924 | Monrose | |
| 1,615,629 A | | 1/1927 | Johnson | |
| 2,048,531 A | | 7/1936 | Yerkes | |
| 2,591,462 A | | 4/1952 | Mungo | |
| 2,703,884 A | | 3/1955 | Roth | |
| 2,866,462 A | | 12/1958 | Faron | |
| 2,887,113 A | | 5/1959 | Gingras | |
| 3,140,717 A | | 7/1964 | Gingras | |
| 3,311,113 A | | 3/1967 | Sayers | |
| 3,467,106 A | | 9/1969 | Halstead | |
| 3,521,642 A | * | 7/1970 | Jordan | 450/57 |
| 3,554,190 A | | 1/1971 | Kaplan | |
| 3,699,971 A | | 10/1972 | Hittel et al. | |
| 4,023,575 A | * | 5/1977 | Nixon | 450/57 |
| 4,781,651 A | | 11/1988 | Ekins | |
| 4,909,771 A | | 3/1990 | Bergman | |
| 5,395,280 A | * | 3/1995 | Greenberg | 450/54 |
| 5,427,563 A | | 6/1995 | Manning | |
| 5,507,681 A | | 4/1996 | Smith et al. | |
| 5,690,537 A | * | 11/1997 | Kalmus | 450/57 |
| 5,820,445 A | | 10/1998 | Smith et al. | |
| 5,873,768 A | | 2/1999 | Fleischman-Ament | |
| 5,916,829 A | | 6/1999 | Girard et al. | |
| 5,940,888 A | * | 8/1999 | Sher | 2/267 |
| 5,984,762 A | | 11/1999 | Tedeschi et al. | |
| 6,053,800 A | | 4/2000 | Lattanzi | |

* cited by examiner

*Primary Examiner*—Gloria M. Hale
(74) *Attorney, Agent, or Firm*—Akerman Senterfitt

(57) ABSTRACT

A brassiere comprises a pair of cups for supporting and shaping the breasts of the wearer. The cups are connected by connecting structure. A side panel is attached to each cup. Each side panel has a surface for contacting the wearer. The side panels are adapted to apply substantially uniform pressure to the wearer across the surface in contact with the wearer for the purpose of increasing comfort and reducing unsightly bulging of tissue of the wearer's sides and back.

5 Claims, 3 Drawing Sheets

BRASSIERE WITH DETACHABLE UNIFORM PRESSURE ASSEMBLY

FIELD OF THE INVENTION

This invention relates generally to brassieres, and more particularly brassieres adjusted for increased comfort and improved appearance in the wearer's back region.

BACKGROUND OF THE INVENTION

A brassiere typically comprises two cups adapted to support and shape the breasts of the wearer. The cups are connected to each other at one lateral edge thereof by a suitable connecting member, which can be stitching between the cups themselves, but more often is a strap-like member bridging from one cup to the other. Side panels extend from a lateral side of each cup and typically include fastening structure at opposite ends such that the side panels can wrap around the back of the wearer and fasten to one another to position and secure the bra. Shoulder straps extending from upper regions of the cups and connecting to the side panel are frequently provided to further assist the positioning and supporting the cups from over the shoulders.

The side panels of bras frequently are the cause of discomfort and unsightly bulging. The side panels typically comprise banded support at each lateral edge thereof which is bridged by a thin web material that is less thick and supportive than the side bands. The result of this is that the side bands, when fastened around the back of the wearer, tend to press strongly into the skin of the wearer, resulting in discomfort for the wearer. Also, as the web material is not as thick and does not press into the skin of the wearer, there is a bulging of the skin of the wearer between the side bands and laterally outside of the side bands.

Additionally, the side panels are often constructed of the same material as the cups. The material is often only unidirectionally elastic, that is, it is substantially more elastic is a first, typically longitudinal direction, than in a second, transverse direction. There generally very little elasticity in the transverse direction. In the case of the panels, this lack of transverse elasticity contributes to the bulging effect of the prior art panels.

SUMMARY OF THE INVENTION

A brassiere comprises a pair of cups for supporting and shaping the breasts of the wearer. The cups are connected by connecting structure. A side panel is attached to each cup. Each side panel has a surface for contacting the wearer. The side panels are adapted to apply substantially uniform pressure to the wearer across the surface in contact with the wearer.

Each side panel can comprise an elastic material. The material is substantially uniformly elastic, at least longitudinally and laterally. The side panel in one aspect is substantially uniformly elastic in all directions in the plane of the side panel material. These uniformly elastic side panels can be utilized with brassiere cups made of different material, particularly, unidirectionally elastic material.

Each side panel can comprise fastening structure at an end opposite to the cup for fastening the side panels together. Shoulder straps can be provided to position and secure the brassiere.

The side panels can comprise detachable structure for applying substantially uniform pressure to the wearer across the surface of the side panel in contact with the wearer. The side panel can include a pocket and the detachable structure can comprise an insert. The insert is positionable in the pocket. The insert can be substantially in the shape of the side panel so as to substantially fill the area between lateral edges of the side panel. The insert is, in one aspect, flexible.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figure 1:
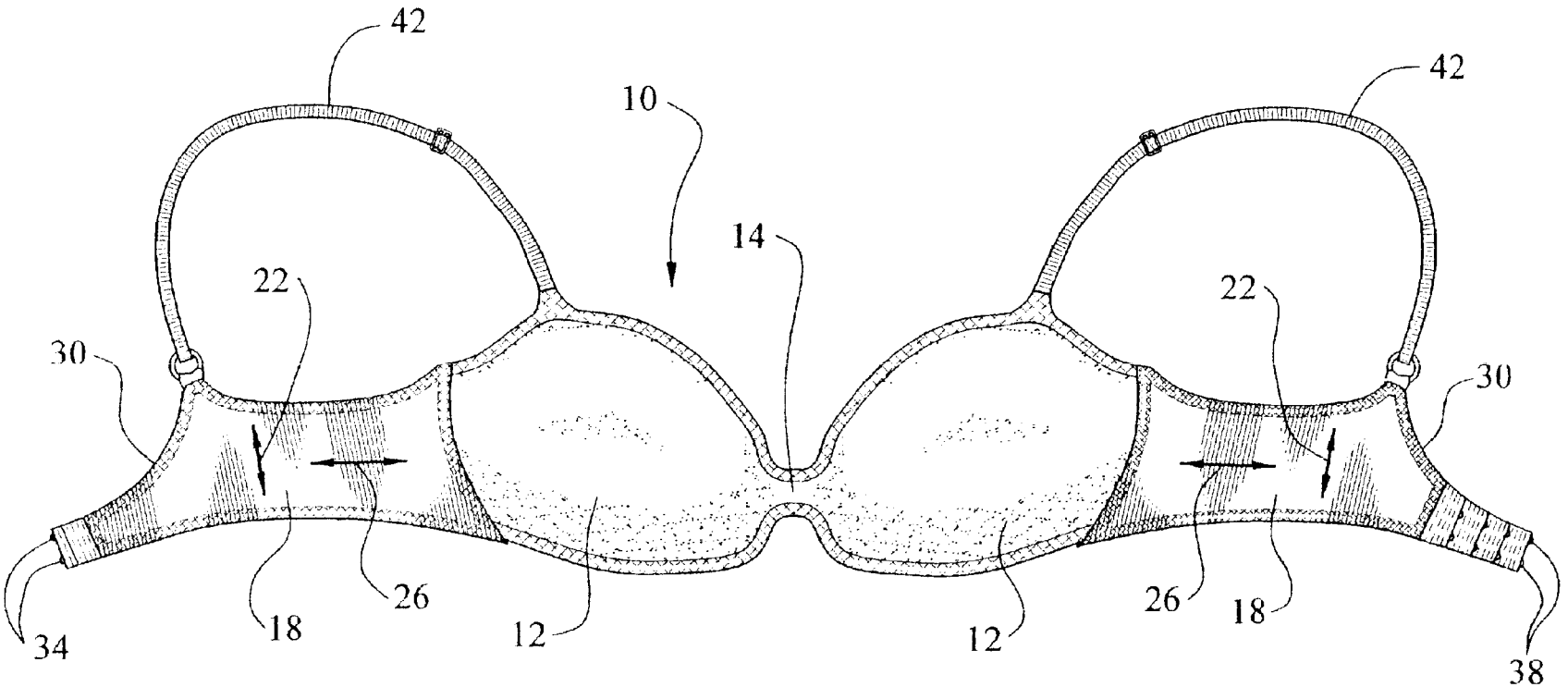
FIG. 1 is a rear elevation of a brassiere according to aspects of the invention.

There is shown in FIG. 1 a brassiere 10 according to the invention. The brassiere 10 includes a pair of cups 12 for supporting and shaping the breasts of the wearer. The cups 12 are connected by a suitable connecting member such as the connecting member 14. Side panels 18 are provided and secured to the cups 12 at ends opposite to the connecting member 14.

The side panels 18 are constructed of a material which is elastic substantially to the same degree in multiple directions. The elastic material is capable of stretching both in the lateral direction indicated by arrow 22 and in the longitudinal direction as indicated by arrows 26. In another aspect of the invention, the side panels 18 can be constructed of a material which is substantially elastic in all directions in the plane of the side panels 18. The side panels 18 can have thin side stitching 30 to prevent fraying and curling at the edges of the side panels 18.

The brassiere 10 can have fastening structure for fastening the side panels 18 together. The fastening structure can be any suitable structure and can have a first portion 34 secured to one side panel 18 and cooperating fastening structure 38 secured to the other side panel 18. The cooperating fastening structure can be clasps. In another aspect of the invention, the fastening structure can be cooperating hook and loop fastening structure such as Velcro®. In yet another aspect of the invention, the side panel 18 can be joined at ends so as to form one substantially continuous side panel which extends from one of the cups 12 to the other cup 12. Shoulder straps 42 can be provided to further position and secure the brassiere in place.

Figure 2:
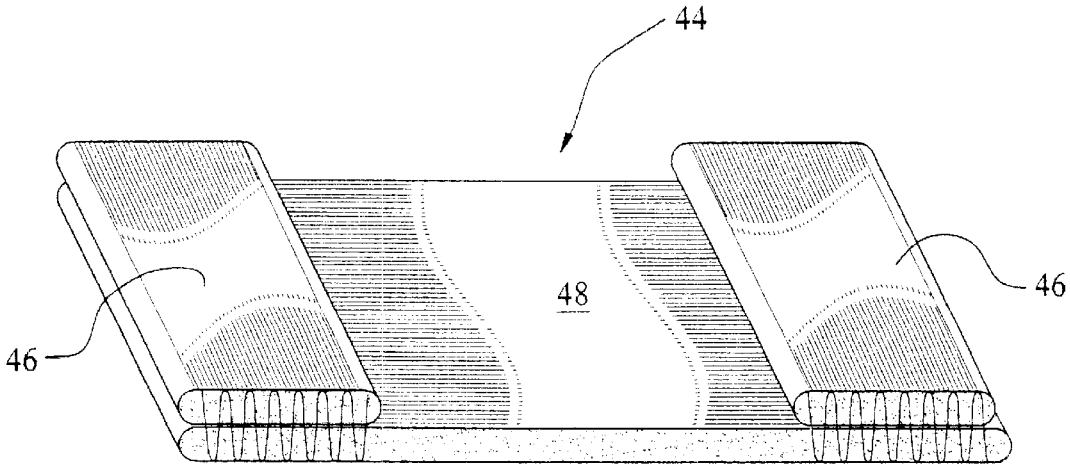
FIG. 2 (PRIOR ART)
FIG. 2 is a sectional view of a brassiere back panel according to prior constructions.
Figure 3:
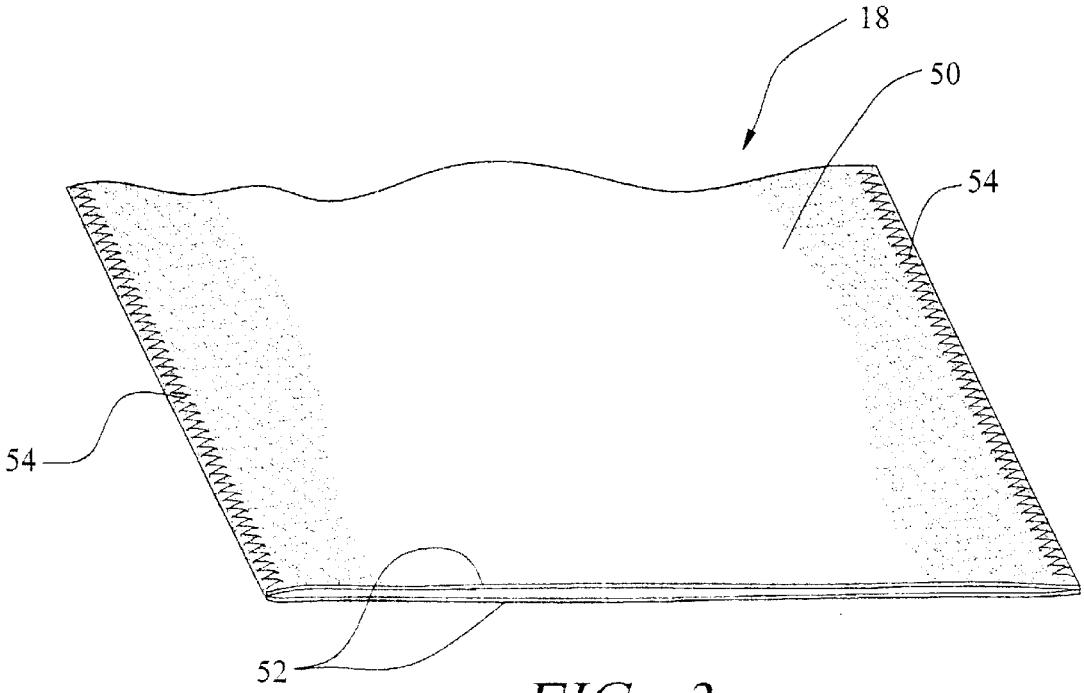
FIG. 3 is a sectional view of a brassiere back panel according to aspects of the invention.

Referring to FIGS. 2 and 3, a side panel 18 according to the invention has a substantially uniform thickness. The prior art panel construction 44 as illustrated in FIG. 2 includes side bands 46 along the longitudinal periphery that are bound to the relatively thin, single ply web material 48 in between by stitching. According to the invention, a uniformly thick web material, for example an elastic material 50 having two plies 52, is utilized without side banding and reinforced at its periphery only by stitching 54. Thus, a side panel 18 according to the invention provides a uniform number of plies of material across its entire width to provide a substantially uniform thickness.

Figure 4:
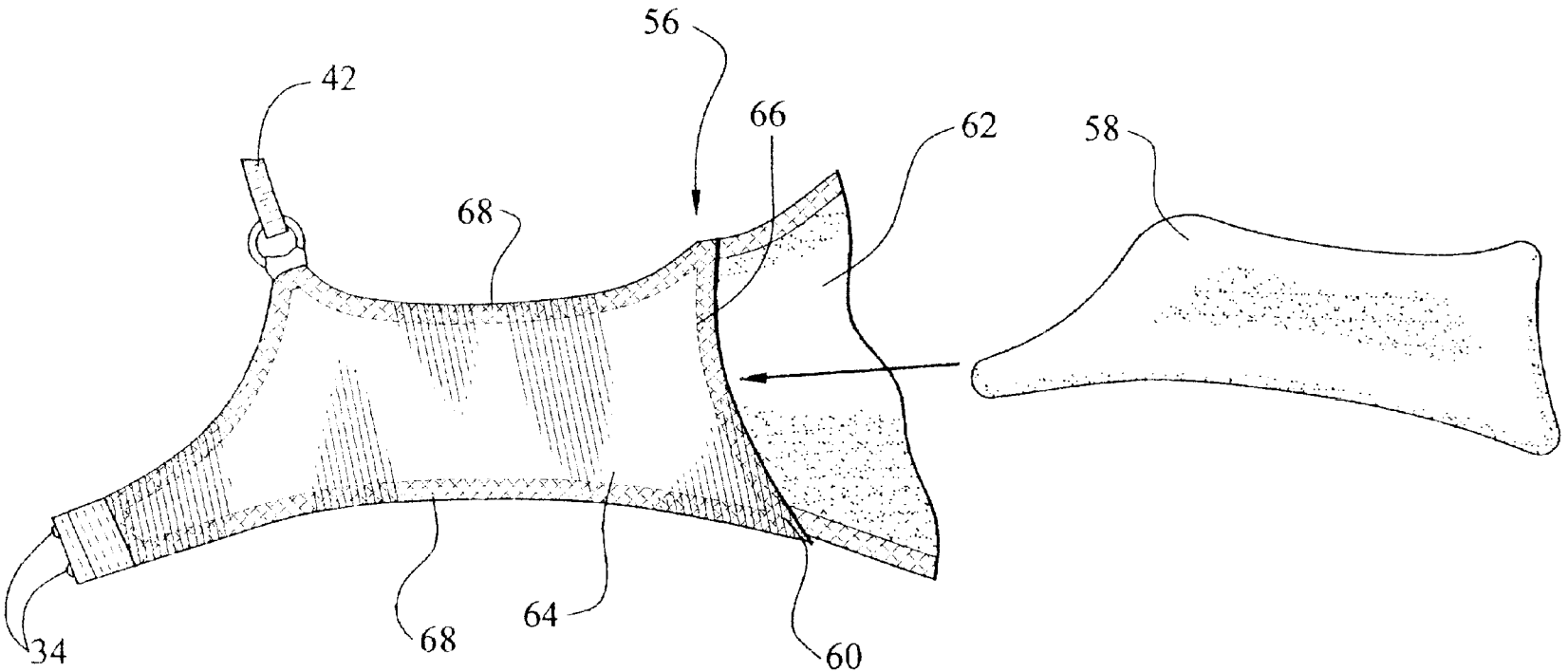
FIG. 4 is an exploded side elevation of a side panel according to an alternative embodiment of the invention.

An alternative embodiment of the invention is shown in FIG. 4. In this embodiment, each cup is joined by an alternative side panel 56. The side panel 56 has structure for engaging detachable structure. The detachable structure is, in one aspect, a flexible insert 58 which is adapted to provide substantially uniform pressure against the skin of the wearer across the surface of the side panel 56 that contacts the wearer. The uniform-pressure can be the result of a detachable structure that is substantially the width of this side panel 56, or that fills the area between side bands of the side panel so as to present substantially uniform pressure against the wearer. The engagement structure for engaging the detachable structure can be any suitable structure, but preferably comprises a pocket 60 adapted to receive the insert 58. The side panel 56 can comprise a facing 62. A pocket layer 64 is joined to the facing 58 with an open end 66 so as to form a pocket adapted to receive the insert 58. The pocket layer 64 is preferably dimensioned so as to substantially conform to the shape and dimensions of the facing 62. The insert 58 is also preferably adapted to conform to the dimensions and shape of the pocket, such that substantially the entire area of the side panel 56 in contact with the wearer is covered by the insert 58. In this manner, substantially uniform pressure is applied by the side panel 56 to the skin of the wearer in contact with the side panel 56. The pocket layer 64 can be joined to the facing layer 62 by any suitable structure, including stitching 68 at edges of the side panel 56. Fastening structure 34 can be provided as previously described, or the two side panels can be joined at the rear by a piece of bridging material. Each facing layer 62 and pocket layer 64 can be formed from any suitable material, including elastic materials. The insert 58 is preferably made of a firm but flexible material. Foamed polymeric materials and padding can be used.

This invention can be embodied in other specific forms without departing from the spirit or essential attributes thereof, and accordingly, reference should be had to the following claims, rather than to the foregoing specification, as indicating the scope of the invention.

What is claimed is:

1. A brassiere, comprising:

a pair of connected cups for supporting and shaping the breasts of the wearer;

first and second side panels each having opposing ends, each of said side panels attached at one end to a respective cup and terminating at the opposite end, each side panel having a surface for contacting a wearer, said panels comprise detachable structure for applying substantially uniform pressure to the wearer across the surface of said side panel in contact with said wearer.

2. The brassiere of claim 1, wherein said side panels comprise a pocket and detachable structure comprises an insert, said insert being positionable in said pocket.

3. The brassiere of claim 2, wherein said insert is substantially planar and substantially in the shape of but smaller than said side panel.

4. The brassiere of claim 2, wherein said insert is flexible.

5. The brassiere of claim 4, wherein said insert is a polymeric foam material.

* * * * *